United States Patent [19]

Schmidt

[11] 4,186,755

[45] Feb. 5, 1980

[54] TOBACCO DRYING APPARATUS

[75] Inventor: Herbert Schmidt, Glinde, Fed. Rep. of Germany

[73] Assignee: Hauni-Werke Körber & Co. KG, Hamburg, Fed. Rep. of Germany

[21] Appl. No.: 815,500

[22] Filed: Jul. 14, 1977

[30] Foreign Application Priority Data

Aug. 26, 1976 [DE] Fed. Rep. of Germany ..... 2638446

[51] Int. Cl.[2] ..... A24B 3/10; A24B 3/12

[52] U.S. Cl. ..... 131/135; 131/136; 131/137; 34/91

[58] Field of Search ..... 131/133–137, 131/140 R, 140 A; 34/135–137, 191

[56] References Cited

U.S. PATENT DOCUMENTS

| | | | |
|---|---|---|---|
| 3,372,488 | 3/1968 | Koch et al. | 34/136 X |
| 3,386,447 | 6/1968 | Wochnowski | 131/135 |
| 3,389,707 | 6/1968 | Wochnowski | 131/140 R X |

*Primary Examiner*—V. Millin

*Attorney, Agent, or Firm*—Peter K. Kontler

[57] ABSTRACT

Apparatus for drying tobacco which is caused to pass through a steam-heated rotating drum has a blower for admission of hot air into a first conduit which discharges hot air into the inlet of the drum or into a second conduit which discharges hot air into the outlet of the drum. The temperature of hot air which flows into the inlet is regulated in dependency on changes in moisture content of tobacco ahead of the drum, and the temperature of hot air which flows into the outlet is regulated in dependency on changes in moisture content of dried tobacco. A first pipe draws vapors-containing air from the outlet when the drum receives hot air via first conduit, and a second pipe draws vapors-containing air from the inlet when the drum receives hot air from the second conduit.

15 Claims, 1 Drawing Figure

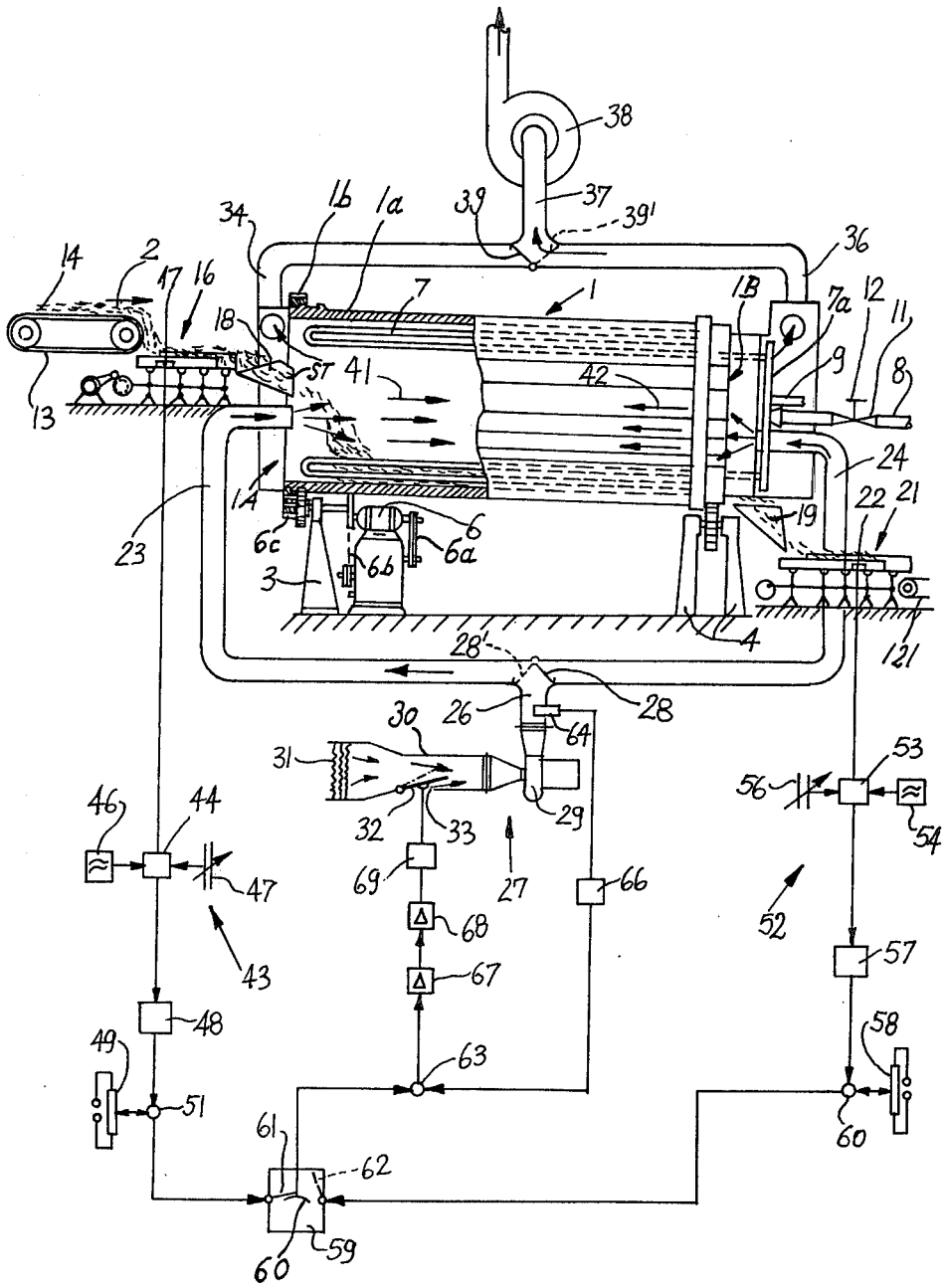
38
37
39
39'
36
34
1b
1a
14
2
47
16
7
1
1B
7a
12
11
18
57
41
42
9
8
13
24
1A
22
21
19
23
6c
6
6a
6b
3
4
121
28'
26
28
30
64
31
53
56
46
44
32
33
29
54
47
69
27
66
52
68
43
67
57
48
58
49
63
51
61
62
60
59
60

TOBACCO DRYING APPARATUS

BACKGROUND OF THE INVENTION

The present invention relates to apparatus for conditioning tobacco, and more particularly to improvements in apparatus for reducing the moisture content of tobacco. Still more particularly, the invention relates to improvements in apparatus wherein tobacco is dried during travel through a conditioning zone wherein the particles of tobacco are brought into indirect and/or direct contact with a heating fluid.

In certain presently known dryers, the moisture content of tobacco is reduced during travel through a rotating drum which is heated by one or more coils. As a rule, steam which is circulated in the coils provides a basic or primary heating action which may but need not be adjustable. The coils come into direct contact with tobacco particles and/or heat the rotating drum. In most instances, fresh steam is admitted into and spent steam is evacuated from the coils at the outlet or discharge end of the drum.

It is also known to reduce the moisture content of tobacco by admitting a hot gaseous fluid (e.g., air) at the inlet or at the outlet of the rotating drum, i.e., hot air can flow concurrent with or countercurrent to the direction of tobacco travel through the conditioning zone. Certain presently known dryers are provided with means for admitting a hot gaseous fluid concurrent as well as countercurrent to the direction of tobacco travel, for example, in such a way that the upstream half of the conditioning zone receives hot air which flows toward the outlet and the downstream half of the conditioning zone receives hot air which flows toward the inlet of the drum. Spent air is evacuated from the median portion of the conditioning zone, i.e., substantially midway between the ends of the drum.

Each of the just enumerated conventional apparatus exhibits important advantages as well as one or more serious drawbacks. Thus, dryers which are designed exclusively for concurrent flow of hot gases can utilize relatively simple and inexpensive controls which insure that the final moisture content equals or approximates an optimum value. The controls of a dryer for countercurrent flow of hot gases are much more complex and expensive. However, a dryer for countercurrent flow of hot gases exhibits the advantage that tobacco particles which are about to leave the conditioning zone are contacted by very hot gases. This enables the hot gases to influence casing and other flavoring agents so that the additives effect more pronounced and highly desirable changes in taste and/or other qualities of tobacco. The dryers wherein the drum receives hot gases at both ends must be equipped with expensive and highly complicated controls, and the evacuation of spent gases midway between the ends of the drum also presents many problems, mainly because the drum rotates.

OBJECTS AND SUMMARY OF THE INVENTION

An object of the invention is to provide a novel and improved tobacco conditioning apparatus which can replace two conventional apparatus.

Another object of the invention is to provide a conditioning apparatus which can be rapidly converted for drying of tobacco with a heating fluid whose drying action depends on one or more characteristics of untreated or dried tobacco.

A further object of the invention is to provide an apparatus which can be used for drying of all or nearly all tobacco types or brands and whose drying action is not affected by changes in the type of admitted tobacco.

An additional object of the invention is to provide an apparatus whose energy requirements are low, whose controls are relatively simple, and which can be readily adjusted to change the final moisture content of tobacco within a desired range.

An ancillary object of the invention is to provide the apparatus with novel and improved means for selecting the direction of flow of a gaseous tobacco conditioning medium in the above outlined apparatus.

A further object of the invention is to provide a tobacco dryer wherein vapors which develop in the course of drying can be collected regardless of the direction of flow of gaseous heating medium with respect to the direction of tobacco travel through the drying zone.

The invention is embodied in an apparatus for drying tobacco which comprises a conditioning unit (such unit may include a rotary drum) having an inlet and an outlet, a chute or other suitable means for feeding tobacco into the inlet (the tobacco is preferably fed in the form of a continuous stream), means for effecting the movement of tobacco from the inlet to the outlet (such means may include a support which causes the aforementioned drum to slope downwardly in a direction from the inlet toward the outlet and/or steam-heated coils which are mounted in the drum and act not unlike paddles to advance tobacco toward the outlet), a chute or analogous means for receiving conditioned tobacco from the outlet, a source of fluid heating medium, a conduit or analogous means for conveying heating medium from the source into the inlet of the conditioning unit, a conduit or analogous means for conveying heating medium from the source to the outlet of the conditioning unit, and a valving element or analogous switchover means which is operative to connect the source with the first mentioned conveying means while sealing the source from the last-mentioned conveying means and vice versa, i.e., tobacco in the conditioning unit can be dried by heating medium which flows concurrent with or countercurrent to the direction of tobacco travel through the conditioning unit. The heating medium is preferably hot air.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a diagrammatic partly elevational and partly sectional view of a tobacco conditioning apparatus which embodies one form of the invention.

DESCRIPTION OF THE PREFERRED EMBODIMENTS

The drawing shows a tobacco conditioning apparatus which comprises a conditioning or drying unit 1 including a rotary tubular member or drum 1*a* mounted on frame members 3 and 4 and driven by a gear motor 6 through the medium of suitable belt and/or chain transmissions 6*a*, 6*b*. The transmission 6*b* drives a pinion 6*c* which is in mesh with a ring gear 1*b* at the periphery of the drum 1*a*. The axis of the drum 1*a* is inclined downwardly in a direction to the right, as viewed in the drawing, so as to promote the travel of tobacco particles from the inlet 1A toward the outlet 1B of the conditioning unit 1. The inlet receives tobacco particles in the form of a continuous stream ST which advances in the direction indicated by arrow 2.

The drum 1*a* contains several heating coils 7 which are adjacent to its internal surface and are parallel to its axis. The coils 7 receive steam or another suitable heating medium from a supply conduit 8 which is provided with a valve 11 and admits heating medium to a distributor 7*a* connected to the coils 7. When the motor 6 is on, the coils 7 act not unlike paddles by agitating the particles of tobacco in the conditioning zone, i.e., during travel through the interior of the drum 1*a*. The pipe 8 supplies heating medium to those portions of the coils 7 which are adjacent to the outlet 1B of the unit 1. The reference character 9 denotes a pipe which receives spent heating medium from the coils 7; the admission of spent heating medium into the pipe 9 also takes place at the oulet 1B of the unit 1. As a rule, heating medium which is supplied by the pipe 8 is hot steam or saturated steam.

It is equally within the purview of the invention to replace the fluid-heated coils 7 which electrically heated agitating elements. If the elements 7 are steam-heated coils, the valve 11 is adjusted by an actuating element 12 which can be manipulated by hand, preferably in such a way that the heating action of coils 7 is dependent on the moisture content of the stream ST. The moisture content which determines the setting of valve 11 may be the initial or final moisture content of particles forming the tobacco stream ST.

The means for feeding tobacco particles to the inlet 1A of the unit 1 comprises a belt conveyor 13 whose upper reach advances a layer 14 of particles in the direction indicated by arrow 2. The leader of the layer 14 is showered onto a vibratory conveyor 16 which, in turn, delivers the particles into a downwardly inclined chute 18. The latter converts the particles into the stream ST which enters the inlet 1A.

Conditioned tobacco which leaves the drum 1*a* via outlet 1B is received by a second chute 19 which feeds the material onto a second vibratory conveyor 21. A take-off conveyor 121 receives conditioned tobacco from the discharge end of the conveyor 21.

A first moisture detector 17 is mounted in or adjacent to the vibratory conveyor 16 to determine the (initial) moisture content of successive increments of the layer 14 which advances toward the tobacco feeding chute 18. An analogous or identical moisture detector 22 is mounted in, on or adjacent to the vibratory conveyor 21 to determine the (final) moisture content of particles which are caused to advance toward the take-off conveyor 121.

The apparatus further comprises a conduit 26 which can communicate with one of two conduits 23 and 24 respectively serving to convey currents of hot air into the inlet 1A and outlet 1B of the unit 1. The conduit 26 receives hot air from a source 27 including a blower 29 whose intake is connected to a suction pipe 30. The left-hand end of the pipe 30 is open to admit atmospheric air which is heated by an electric resistance heater 31. The temperature of hot air entering the blower 29 can be regulated by a flap 32 which controls the effective area of an opening 33 in the tubular wall of the pipe 30 and can be pivoted or otherwise moved by a servomotor 69. When the flap 32 is pivoted anticlockwise, as viewed in the drawing, the temperature of air in the conduits 26 and 23, 24 is reduced because the opening 33 admits a larger quantity of cool atmospheric air which is mixed with air heated by the device 31.

The junction between the conduits 23, 24 and the conduit 26 contains a switchover means here shown as a two-position valving element or flap 28 which can seal the conduit 23 or 24 from the outlet of the blower 29, i.e., the conduit 23 admits hot air into the inlet 1A of the unit 1 when the outlet 1B of the unit 1 is sealed from the conduit 26 and vice versa.

A pipe 37 can communicate with one of two pipes 34, 36 which respectively serve to evacuate vapors from the inlet 1A and outlet 1B of the unit 1. The pipe 37 is connected to the intake of an exhaust fan 38 and the junction between pipes 37 and 34, 36 contains a pivotable valving element or flap 39 which can be moved to the solid-line position or to the broken-line position 39' to thereby seal the pipe 34 or 36 from the fan 38.

The arrows 41 indicate the direction of flow of hot air from the conduit 23 into the interior of the drum 1*a*. It will be noted that, when the flap 28 assumes the solid-line position, gaseous heating medium flows concurrent with the flow of tobacco stream ST, i.e., from the inlet toward the outlet of the unit 1. When the heating medium issues from the conduit 24 (arrows 42), it flows countercurrent to the direction of tobacco transport through the conditioning unit 1.

The regulating unit 43 for admission of heating medium via conduit 23 includes an oscillator 44 one input of which is connected with the moisture detector 17. The oscillator 44 is further connected to a high-frequency generator 46. The frequency of the oscillator 44 can be varied by a predetermined value (resonance point) through the medium of a capacitor 47 whose capacitance varies periodically. The moisture detector 17 includes or constitutes a capacitor whose capacitance is a function of the moisture content of successive increments of tobacco between the plates of the detector 17. Such capacitance influences the amplitude of the oscillator 44, and the amplitude is monitored by a peak voltmeter 48. The signal at the output of the voltmeter 48 varies as a function of the changes in moisture content of tobacco stream ST.

The reference signal which designates the desired initial moisture content is furnished by an adjustable potentiometer 49 which transmits the reference signal to a signal comparing junction 51. The latter further receives signals from the voltmeter 48 and its output transmits a plus or minus signal when the measured initial moisture content of tobacco deviates from the desired or optimum moisture content.

A second (follow-up) regulating unit 52 controls the admission of heating medium via conduit 24 in dependency on the characteristics of signals transmitted by the moisture detector 22. The elements of the regulating unit 52 are identical with those of the regulating unit 43, i.e., the unit 52 comprises an oscillator 53, a capacitor 56, a high-frequency generator 54, a peak voltmeter 57, a source 58 of reference signals denoting the desired final moisture content of tobacco, and a signal comparing junction 60.

The signals from the outputs of junctions 51 and 60 are transmitted to the corresponding inputs of a switch-over unit 59 with two mobile contacts 61, 62 and a third contact 60. The latter is connected with one input of a signal comparing junction 63 the other input of which is connected to a temperature monitoring device 64 in the conduit 26 via transducer 66. The signal from transducer 66 to the junction 63 denotes the actual temperature of hot air in the conduit 26, and the junction 63 transmits a signal to a preamplifier 67 when the intensity of signal from transducer 66 deviates from intensity of signal from the contact 60, i.e., when the actual moisture content (determined by detector 17 or 22) deviates from the desired moisture content. The preamplifier 67 is connected with an operational amplifier 68 for the motor 69 which serves to adjust the flap 32.

The operation:

If the tobacco stream ST is to be contacted and dried by the current of hot air issuing from the conduit 23 (arrows 41), the flaps 28 and 39 assume the solid-line positions and the movable contact 61 engages the contact 60. Thus, the temperature of hot air supplied by the source 27 is regulated by the unit 43. The regulating unit 52 is idle and vapors reaching the outlet 1B of the unit 1 are withdrawn by the fan 38 via pipes 36 and 37.

The conveyor 13 delivers tobacco 14 at a constant or nearly constant rate. This is achieved by the provision of a suitable weighing device which precedes the conveyor 13 and supplies thereto metered quantities of moist tobacco. Such weighing devices are known and are standard components of many conventional tobacco conditioning apparatus. However, the feeding of tobacco at a constant rate is not absolutely necessary; eventual fluctuations of the rate of tobacco feed can be compensated for by signals supplied by the regulating unit 43. Thus, if the rate of tobacco feed increases, the moisture detector 17 transmits a signal which is indicative of a higher moisture content. Alternatively, the junction 51 of the regulating unit 43 could receive an additional signal from a device which monitors changes in the rate of tobacco delivery to the drum 1*a*.

The conveyor 13 delivers tobacco into the trough of the conveyor 16 which, in turn, delivers tobacco into the chute 18. The stream ST thereupon enters into and is conditioned during transport through the drum 1*a*. The detector 17 monitors the moisture content of successive increments of the stream on the conveyor 16 and transmits signals to the oscillator 44 of the regulating unit 43. The amplitude of oscillators of the oscillator 44 is indicative of the moisture content of the respective increments of tobacco. The signal is rectified by voltmeter 48 and the resulting d-c signal is also indicative of the moisture content. The junction 51 furnishes a signal which is indicative of the difference between the signals from the voltmeter 48 and potentiometer 49; such signal is transmitted to the junction 63 via contacts 60, 61. The junction 63 further receives a signal from the transducer 66 and transmits a signal to the servomotor 69 to effect an appropriate adjustment of the flap 32 if and when the intensities or other characteristics of signals from 51 and 66 to 63 are not identical. The servomotor 69 pivots the flap 32 clockwise or anticlockwise, depending on the sign of the signal which is transmitted by the junction 63 via amplifiers 67 and 68. Thus, the temperature of air flowing from the conduit 26 into conduit 23 and thence into the drum 1*a* is regulated as a function of changes in initial moisture content of tobacco. The stream ST is conditioned by hot air which flows in the direction indicated by arrows 41 as well as by steam which heats the coils 7 and the drum 1*a*. As mentioned above, it is assumed that the valve 11 in the steam supply pipe 8 is adjusted by hand (at 12) so that the coils 7 furnish a constant heating action. However, it is equally within the purview of the invention to replace the manually adjustable actuating means 12 with a motor which adjusts the valve 11 in automatic response to signals from the detector 17 or 22, i.e., in response to fluctuations of initial or final moisture content of tobacco. Thus, the just mentioned motor can be regulated by the unit 43 or 52.

Conditioned tobacco leaves the outlet of the drum 1*a* to descend into the chute 19 on its way onto the conveyors 21 and 121. Hot air which is admitted by the conduit 23 and is enriched with moisture during contact with tobacco in the conditioning zone is exhausted by the fan 38 via pipes 36 and 37.

If the operator decides to condition tobacco by contact with hot air which flows counter to the direction of travel of the stream ST, i.e., in the direction indicated by arrows 42, the flaps 28, 39 are caused to assume the positions 28', 39', the contact 61 is disengaged from the contact 60 and the latter is engaged by the contact 62. The conduit 23 is then sealed from the blower 29 and the pipe 34 receives moist air which has been admitted by the conduit 24. The flap 32 is adjusted by the motor 69 in response to signals from the junction 63; such signals are indicative of differences between the intensity of signal from transducer 66 and from the junction 60 of the regulating unit 52.

The improved apparatus is susceptible of many additional modifications. For example, the heating medium which is admitted into the inlet 1A or into the outlet 1B may be steam or a gas other than air. Steam can be admitted into a first set of coils which rotate with the drum 1*a* and receive fresh steam at the inlet 1A, or into a second set of coils which also rotate with the drum 1*a* and receive fresh steam at the outlet 1B. Such coils can be provided in addition to or as a substitute for the coils 7. Heated air is preferred at this time because it can be brought into direct contact with tobacco and can be supplied by a simpler source.

It is further within the purview of the invention to employ a composite source of heating medium, namely a first source for heating medium which is admitted into the conduit 23 and a second source which admits heating medium into the conduit 24. The same applies for the fan 38, i.e., the latter can be replaced with two discrete fans one of which draws vapor-containing medium from the outlet 1B and the other of which draws vapor-containing medium from the inlet 1A, depending upon whether the drum 1*a* receives heating medium from the conduit 23 or 24. The illustrated apparatus is preferred at this time because it is simpler, more compact and less expensive.

An important advantage of the improved apparatus is that it can be rapidly converted from concurrent to countercurrent conditioning of tobacco with a hot gaseous fluid or vice versa. Furthermore, the controls for the flap 32 are relatively simple, especially in view of the highly improved versatility of the conditioning apparatus.

Another apparatus advantage of the apparatus is that it can replace two discrete dryers, namely a dryer which is designed to heat tobacco by air or another fluid heating medium flowing countercurrent to the direction of tobacco transport and a dryer which heats tobacco by heating medium flowing concurrent with the tobacco stream.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for drying tobacco, comprising a conditioning unit having an inlet and an outlet; means for feeding tobacco into said inlet; means for effecting the movement of tobacco from said inlet to said outlet; means for receiving conditioned tobacco from said outlet; at least one source of fluid heating medium; means for conveying heating medium from said source to said inlet; means for conveying heating medium from said source to said outlet; and switchover means operative to connect said source with said first mentioned conveying means while sealing said source from said last mentioned conveying means and vice versa whereby the tobacco in said conditioning unit is respectively dried by heating medium which flows only from said inlet toward said outlet and vice versa.

2. Apparatus as defined in claim 1, wherein said conditioning unit includes a rotary tubular member.

3. Apparatus as defined in claim 1, wherein said heating medium is hot air.

4. Apparatus as defined in claim 1, further comprising means for regulating the temperature of tobacco in dependency on changes of a characteristic of tobacco ahead of said inlet when said switchover means connects said source with said first mentioned conveying means.

5. Apparatus as defined in claim 4, wherein said regulating means comprises means for monitoring the changes of moisture content of tobacco ahead of said inlet and means for changing the temperature of said heating medium as a function of the extent of deviations of monitored moisture content from a predetermined value.

6. Apparatus as defined in claim 1, further comprising means for regulating the temperature of said heating medium in dependency on changes of a characteristic of tobacco downstream of said outlet while said switchover means connects said source with said last mentioned conveying means.

7. Apparatus as defined in claim 6, wherein said regulating means comprises means for monitoring the changes of moisture content of conditioned tobacco and means for changing the temperature of said heating medium as a function of the extent of deviations of monitored moisture content from a predetermined value.

8. Apparatus as defined in claim 1, wherein said source comprises a gas heater and a first conduit which receives heated gas from said heater, said first mentioned conveying means comprising a second conduit having an intake end adjacent said first conduit and a discharge end in the region of said inlet, said last mentioned conveying means comprising a third conduit having an intake end adjacent to said first conduit and a discharge end in the region of said outlet, said switchover means comprising a valving element movable between a first position in which said valving element establishes communication between said first conduit and the intake end of said second conduit and a second position in which said valving element establishes communication between said first conduit and the intake end of said third conduit.

9. Apparatus as defined in claim 1, further comprising first evacuating means having an intake at said outlet, second evacuating means having an intake adjacent to said inlet, and means for respectively activating said first and second evacuating means when said heating fluid is admitted into said conditioning unit by said first mentioned and last mentioned conveying means whereby said first evacuating means removes heating fluid admitted by said first mentioned conveying means and said second evacuating means removes heating fluid admitted by said last mentioned conveying means.

10. Apparatus as defined in claim 9, wherein said first and second evacuating means respectively comprise first and second pipes having first and second discharge ends and further comprising a suction generating device, said activating means comprising a valving element movable between first and second positions in which said suction generating device respectively communicates with the discharge ends of said first and second pipes.

11. Apparatus as defined in claim 1, further comprising means for heating tobacco in said conditioning unit independently of said heating media.

12. Apparatus as defined in claim 11, wherein said heating means includes a steam heater.

13. Apparatus as defined in claim 12, wherein said heater has an inlet for admission of fresh steam, said inlet being located at the outlet of said condition unit.

14. Apparatus as defind in claim 1, further comprising first and second means for respectively regulating the temperature of said heating medium in dependency on changes of a characteristic of tobacco upstream of said inlet and downstream of said outlet, and means for respectively connecting said first and second regulating means with said source when said switchover means respectively connects said source with said first and second conveying means.

15. Apparatus as defined in claim 14, wherein said first and second regulating means comprise devices for transmitting output signals respectively denoting the moisture content of tobacco ahead and downstream of said conditioning unit, said connecting means comprising switch means operable to transmit to said source one of said output signals at a time.

* * * * *